United States Patent [19]

Pierce

[11] 4,197,829

[45] Apr. 15, 1980

[54] HEAT EXCHANGER FOR USE IN FIREPLACE

[75] Inventor: Jeffrey D. Pierce, Walled Lake, Mich.

[73] Assignee: Heatco, Inc., Hartford, Conn.

[21] Appl. No.: 920,263

[22] Filed: Jun. 29, 1978

[51] Int. Cl.[2] ..... F24B 7/00; F24C 15/10; F24C 15/36; F23H 13/00

[52] U.S. Cl. ..... 126/121; 126/202; 126/164; 126/140

[58] Field of Search ..... 126/121, 138, 139, 164, 126/165, 163 R, 140; 237/51, 50; 165/173

[56] References Cited

U.S. PATENT DOCUMENTS

| | | | |
|---|---|---|---|
| 236,370 | 1/1881 | Smith | 126/121 |
| 2,165,661 | 7/1939 | Stenquist | 126/121 |
| 2,828,078 | 3/1958 | Snodgrass | 237/51 |
| 3,001,521 | 9/1961 | Reilly | 126/121 |
| 3,240,206 | 3/1966 | Schutt | 126/121 |
| 3,452,737 | 7/1969 | Pellegrino et al. | 126/121 |
| 3,901,212 | 8/1975 | Stites | 126/121 |
| 3,905,351 | 9/1975 | Hatfield et al. | 126/121 |
| 3,938,496 | 2/1976 | Kampf et al. | 126/121 |
| 3,945,369 | 3/1976 | Adams et al. | 126/164 |
| 3,955,553 | 5/1976 | Soeffker | 126/121 |
| 4,010,729 | 3/1977 | Egli | 126/121 |
| 4,088,114 | 5/1978 | Johnson | 126/121 X |
| 4,091,794 | 5/1978 | Stites | 126/121 |
| 4,122,825 | 10/1978 | Slate | 126/121 |
| 4,129,113 | 12/1978 | Bergstrom | 126/121 |

*Primary Examiner*—Albert W. Davis
*Assistant Examiner*—Randall L. Green
*Attorney, Agent, or Firm*—Harness, Dickey & Pierce

[57] ABSTRACT

A fireplace heat exchanger which may be used in conjunction with a fireplace screen, such as a glass screen. The heat exchanger comprises a lower header fed by a blower drawing in room air and delivering this air to a plurality of C-shaped tubes in the fireplace capable of supporting logs. These tubes deliver the air to an upper header, from which the air is fed downwardly by a central C-shaped tube to a room delivery chamber below the lower header. The delivery chamber is part of a lower support on which a glass or other fireplace screen may be placed. The air is heated during both its upward and downward travel and is delivered at floor level.

12 Claims, 5 Drawing Figures

HEAT EXCHANGER FOR USE IN FIREPLACE

BACKGROUND OF THE INVENTION

1. Field of the Invention

The invention relates to fireplace heat exchangers of the type which perform the dual function of supporting logs or coals in the fireplace and conducting air from the room, around the logs and back into the room.

2. Description of the Prior Art

Stites, U.S. Pat. Nos. 3,901,212; Soeffker, 3,955,553; and Christophel, 4,018,210 all show fireplace heat exchangers of the above-described general type. However, these heat exchangers all deliver heated air from the upper end of the exchanger so that this air can only be heated during one passage around the logs and flames. Moreover, there is no provision in these prior constructions for use with an existing or to-be-purchased glass fireplace screen of the type which prevents newly heated air from being drawn up the chimney and slows down combustion air rushing into the fireplace.

Other patents discovered in the search which pertain generally to fireplace heat exchangers using tubes and blowers are the following U.S. Pat. Nos.: 236,370 (Smith), 2,165,661 (Stenquist), 2,828,078 (Snodgrass), 3,001,521 (Reilly), 3,240,206 (Schutt), 3,905,351 (Hatfield et al), 3,938,496 (Kampf), 3,945,369 (Adams et al), 4,010,729 (Egli).

However, these prior art patents fail to show one or more of the structural features and advantages discussed below with respect to the present invention.

BRIEF SUMMARY OF THE INVENTION

It is an object of the present invention to provide a novel and improved fireplace heat exchanger which overcomes the deficiencies of previously known constructions and insures that the air drawn in from the room is subjected to heating for a much longer period than previous constructions, thus increasing the heating efficiency of the device.

It is a further object to provide a novel and improved fireplace heat exchanger of this nature which delivers the heated air at floor level rather than several feet above floor level, thus circulating with the cool air adjacent the floor and heating the room in a much more efficient manner.

It is also an object to provide an improved fireplace heat exchanger of this character which is capable of use in conjunction with an existing or later-acquired screen, such as a glass fireplace screen, this screen not interfering in any way with operation of the device.

Briefly, the fireplace heat exchanger of this invention comprises a plurality of parallel C-shaped tubes capable of supporting logs, a lower header connected to the lower ends of said tubes, a blower connected to said header for drawing room air into the header and through the tubes, an upper header connected to the upper ends of said tubes, a return tube having a main portion shaped similarly to said first-mentioned tubes and having its upper end connected to said upper header for receiving heated air delivered to the upper header by said first-mentioned tubes, means delivering said air from the lower end of said return tube to the room, and a platform at the level of said lower return tube end adapted to support the lower edge of a fireplace screen.

DESCRIPTION OF THE PREFERRED EMBODIMENT

Figure 1:
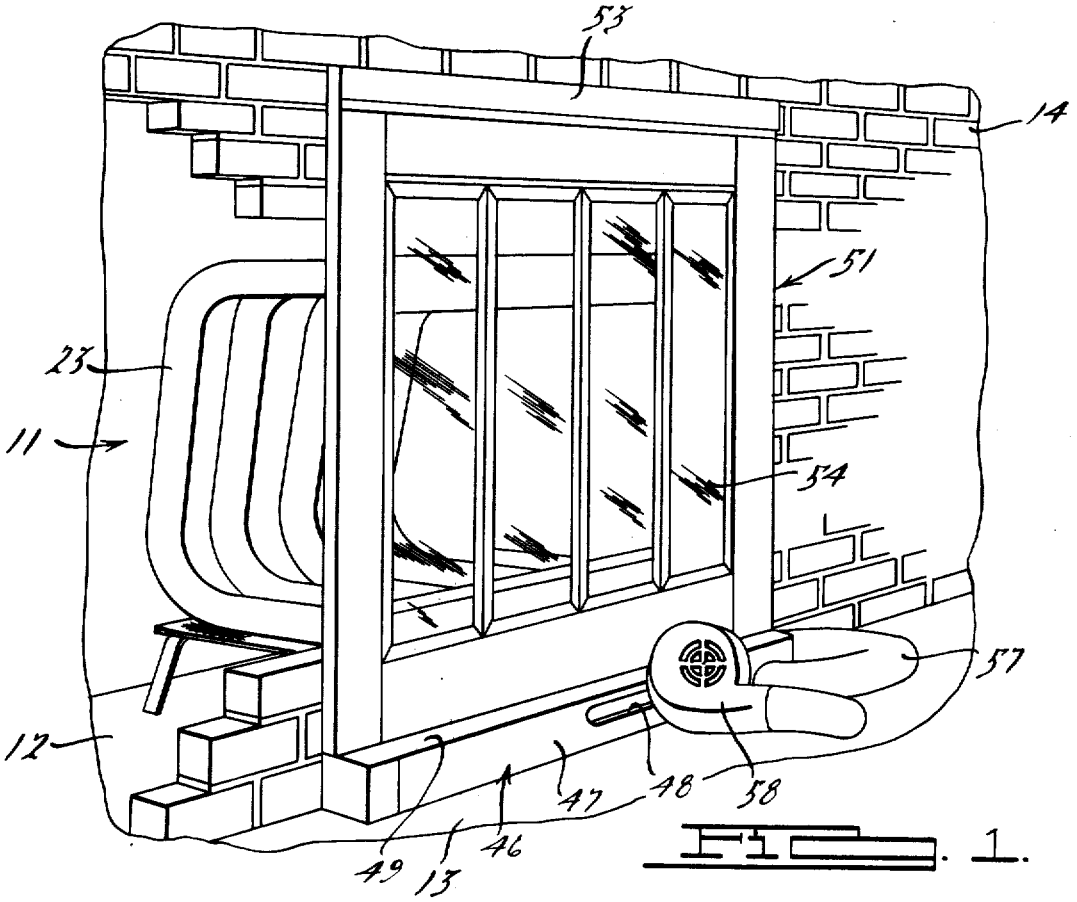
FIG. 1 is a perspective view showing the heat exchanger of this invention installed in a fireplace, the view being from the room.
Figure 2:
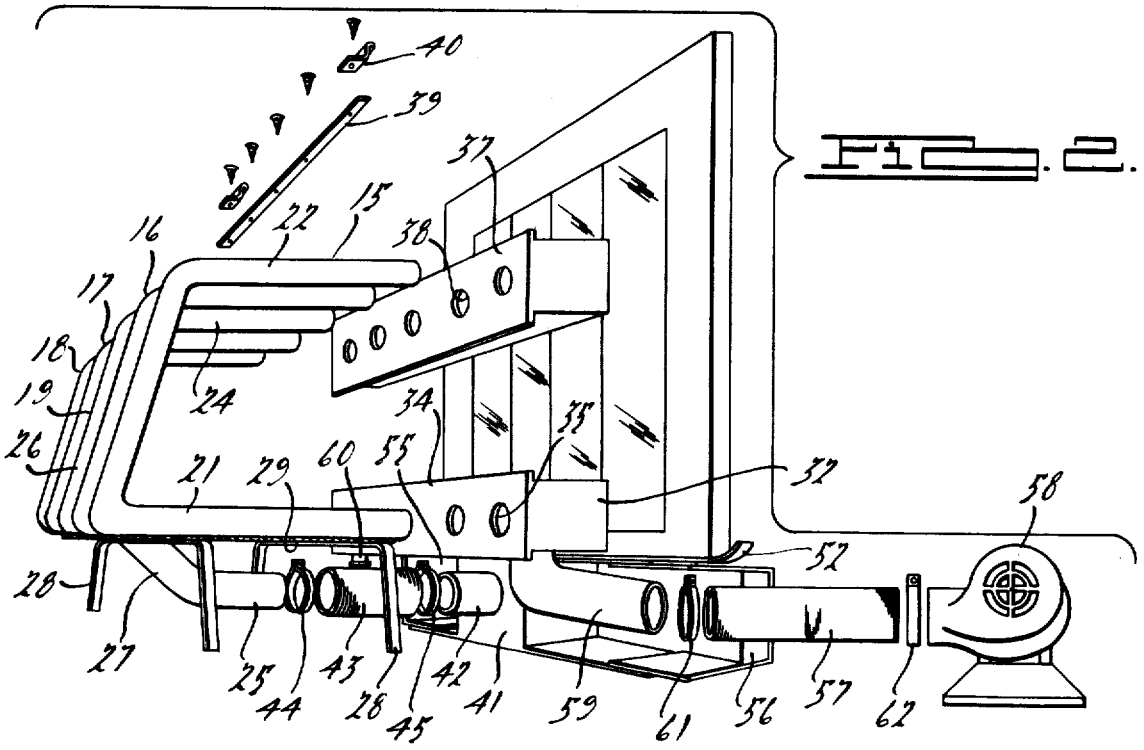
FIG. 2 is an exploded perspective view showing components of the device and seen from inside the fireplace.
Figure 3:
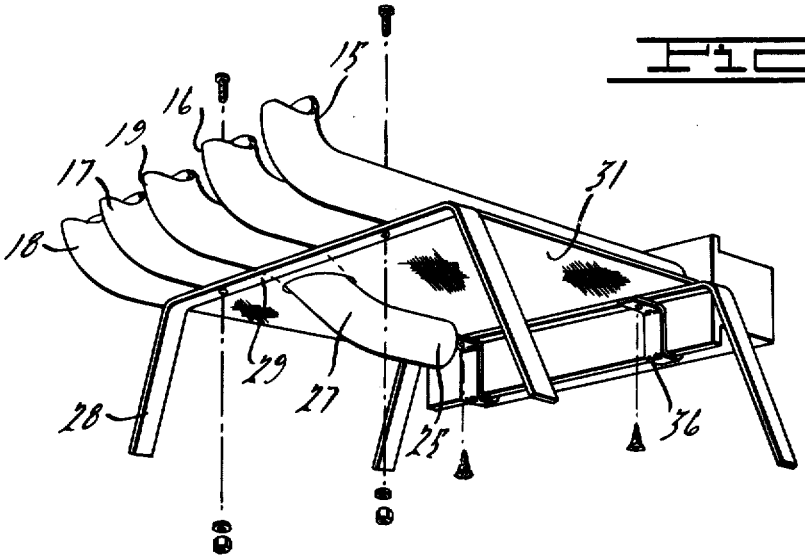
FIG. 3 is a fragmentary perspective view of the underside of the unit, showing the grate and leg construction.

The heat exchanger is generally indicated at 11 and is adapted to be placed in a fireplace having a floor 12 and hearth 13, the fireplace opening being surrounded by a wall 14. The heat exchanger comprises a plurality of inlet tubes 15, 16, 17, and 18, and a return tube 19. These tubes are of approximately C-shaped construction with the inlet tubes 15, 16, 17 and 18 having horizontal log-supporting lower legs 21, and upper legs 22, connected by inclined legs 23. Return tube 19 is disposed between tubes 16 and 17 and has an upper horizontal leg 24, and a lower horizontal leg 25, connected by a leg having a first inclined portion 26, and a bent portion 27. The arrangement is such that leg 25 will be below the level of legs 21 of the inlet tubes.

A plurality of legs 28 are provided for supporting the assembly, these legs being suitably formed from inverted U-shaped metal straps, the horizontal portions 29 of which are bolted to the bottoms of tube portions 21. A grate 31 is also provided underneath the tube portions 21 for supporting coals while permitting ashes to drop through, this grate, for example, being secured between the tubes and members 29. Bent portion 27 of return tube 19 extends through grate 31.

A lower header 32 and an upper header 33 are provided for the tubes. Lower header 32 comprises an elongated box of rectangular cross-sectional shape having a rearwardly facing wall 34 with four apertures 35 for the reception of tube portions 21. Header 32 may be slipped over the ends of tubes 21 until plate 34 engages legs 28. Clips 36 are provided for attaching the tubes to header 32.

Upper header 33 has a rearwardly facing plate 37 with five holes 38 adapted to receive the ends of portions 22 and 24. An upper reinforcing strap 39 surmounting and fastened to the upper tube ends aids in securing them together, and header 33 may be slipped onto the tube end until it engages strap 39. Clips 40 are attached to strap 39 and hold header 33 in place.

An exit chamber 41 is provided beneath header 32, this chamber being of box-like construction and having a rearwardly facing entrance fitting 42. This fitting is connected to the lower portion 25 of tube 19 by a flexible tube 43 and clamps 44 and 45. The flexible tube permits adjustment of the assembly with respect to chamber 41 in several different directions.

A fireplace screen support generally indicated at 46 is provided extending in opposite directions from chamber 41. This support has a forward wall 47 with an elongated slot 48 connected with exit chamber 41. The fireplace screen support also has an upper wall 49 for supporting a fireplace screen generally indicated at 51. Preferably, an asbestos strip 52 or similar seal is placed between surface 49 and the bottom of the screen. The upper portion 53 of the screen is supported by the fireplace lintel. If a glass fireplace screen is used having glass panels 54, the newly heated air will be prevented from being drawn up into the chimney, and combustion air rushing into the fireplace will also be slowed down.

Screen support 46 is also provided with a pair of telescoping end members 55 and 56, which may be adjusted to the width of glass fireplace screen 51. One of these members 55 is adapted to be mounted in the end of the fireplace screen support in a manner so as to close off the support. The other member 56 is adapted to be mounted in such a way as to leave an opening for the passage of a flexible tube 57. This tube connects a portable blower 58 with an inlet tube 59 leading to the bottom of one side of lower header 32. During assembly, members 55 and 56 may be placed at either end of the fireplace screen support, thus adapting the unit for connection with the blower 58 at either end. Two apertures are provided in the underside of header 32 for mounting tube 59 at either end, a plug 60 closing the unused aperture. Clamps 61 and 62 are provided for securing flexible tube 57 to tube 59 and blower 58, respectively.

To install assembled heat exchanger 11, it is set upright and placed as far back in the fireplace as it will go, with upper header 33 behind the fireplace lintel. Glass screen 51 may then be installed.

Figure 5:
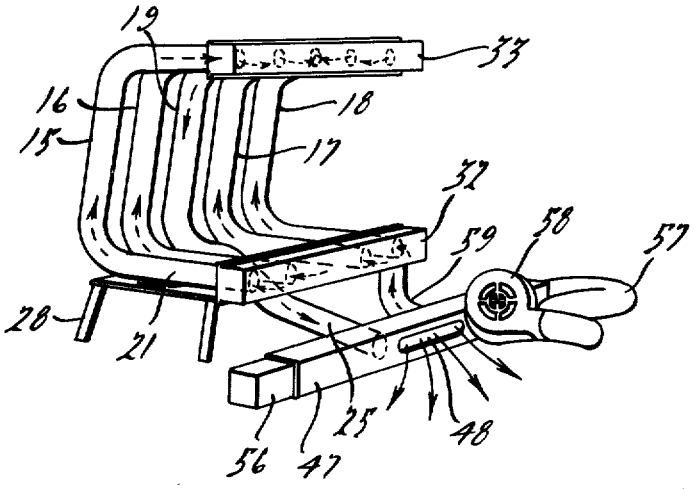
FIG. 5 is a schematic perspective view showing the air-flow pattern through the heat exchanger.
Figure 4:
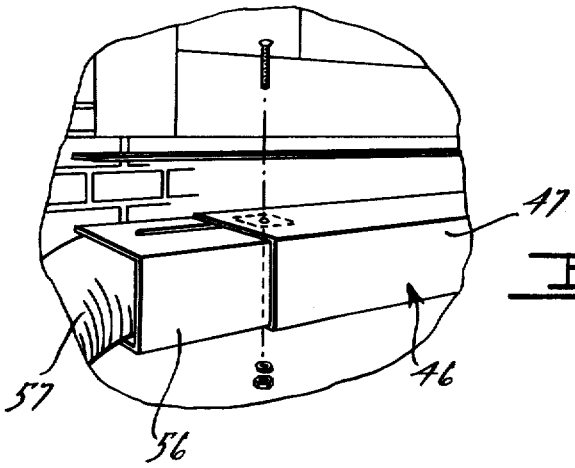
FIG. 4 is a fragmentary perspective view showing how the flexible blower tube leads into an end plate of the screen support.

In operation (FIG. 5), air will be drawn by blower 58 from the room to be heated and will be forced into lower header 32. From there the air will flow through tubes 15, 16, 17 and 18 to upper header 33. The air will be heated by coals or logs resting on lower portions 21 of these tubes and by the flames surrounding the upper portions 22 of the tubes. The heated air will return downwardly through return tube 19 and again will be heated by the flames, as well as the logs or coal. The air will thus exit from opening 48 in a thoroughly heated manner and immediately be emitted at the lowermost portion of the room, namely, adjacent the hearth 13 on which fireplace screen support 47 rests.

Since the construction requires that the air be in the heat exchanger twice as long as prior units which emit air at the top, there will be a much greater extent of heating. Moreover, the fact that the heated air is delivered to the room at the bottom of the unit means that a glass fireplace screen, such as that shown at 51, may be used without interference with functioning of the device.

While it will be apparent that the preferred embodiment of the invention disclosed is well calculated to fulfill the objects above-stated, it will be appreciated that the invention is susceptible to modification, variation and change without departing from the proper scope or fair meaning of the subjoined claims.

I claim,

1. A fireplace heat exchanger comprising a plurality of parallel C-shaped tubes capable of supporting logs, a lower header connected to the lower ends of said tubes, a blower connected to said header for drawing room air into the header and through the tubes, an upper header connected to the upper ends of said tubes, a return tube having a main portion shaped similarly to said C-shaped tubes and having its upper end connected to said upper header for receiving heated air delivered to the upper header by said C-shaped tubes, means delivering said air from the lower end of said return tube to the room, and a platform at the level of said lower return tube end adapted to support the lower edge of a fireplace screen.

2. The combination according to claim 1, said return tube being centrally located with respect to said log supporting tubes.

3. The combination according to claims 1 or 2, said air delivery means comprising a delivery chamber below said lower header and connected to the lower end of said return tube, an exit leading from said delivery chamber to the room, said platform extending on opposite sides of said delivery chamber.

4. The combination according to claim 3, said platform having end plates, and a flexible tube connecting the outlet of said blower to said lower header and passing through one of said plates.

5. The combination according to claim 4, further provided with two openings at opposite ends of said lower header, said flexible tube being connectable to either opening, and a plug for the other opening.

6. The combination according to claim 3, further provided with a flexible connection between the lower end of said return tube and said delivery chamber.

7. The combination according to claim 1, the lower portion of said return tube being at a lower level than the lower portions of said log-supporting tubes, and legs extending downwardly from certain of said log-supporting tubes for supporting the entire heat exchanger in the fireplace.

8. The combination according to claim 7, said legs being formed by inverted U-shaped straps secured to the undersides of the lower ends of said log-supporting tubes, and clips connecting one of said straps to said lower header.

9. The combination according to claim 8, further provided with a reinforcing strap entending across and secured to the upper ends of said tubes, and clips connecting said reinforcing strap with said upper header.

10. The combination according to claims 1, 7, or 8, further provided with a coal-retaining grate secured to the undersides of said log-supporting tubes, the lower portion of said return tube extending through said grate.

11. The combination according to claim 1, said platform being provided with a forward wall and a pair of telescoping end members adjustable to the width of said screen.

12. The combination according to claim 11, further provided with a flexible tube connecting said blower with said lower header, one of said end members being so shaped as to accommodate said flexible tube.

* * * * *